US010731099B2

(12) United States Patent
Hattori et al.

(10) Patent No.: US 10,731,099 B2
(45) Date of Patent: Aug. 4, 2020

(54) HEAT TREATMENT OIL COMPOSITION

(71) Applicant: IDEMITSU KOSAN CO., LTD., Chiyoda-ku (JP)

(72) Inventors: Hideaki Hattori, Funabashi (JP); Katsumi Ichitani, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/550,868

(22) PCT Filed: Feb. 16, 2016

(86) PCT No.: PCT/JP2016/054454
§ 371 (c)(1),
(2) Date: Aug. 14, 2017

(87) PCT Pub. No.: WO2016/133093
PCT Pub. Date: Aug. 25, 2016

(65) Prior Publication Data

US 2018/0023022 A1 Jan. 25, 2018

(30) Foreign Application Priority Data

Feb. 18, 2015 (JP) ..... 2015-030024

(51) Int. Cl.

| | |
|---|---|
| ***C21D 1/58*** | (2006.01) |
| ***C10M 159/12*** | (2006.01) |
| ***C10M 159/02*** | (2006.01) |
| ***C10M 159/04*** | (2006.01) |
| ***C10M 127/00*** | (2006.01) |
| ***C10M 105/00*** | (2006.01) |
| ***C10M 169/04*** | (2006.01) |

(52) U.S. Cl.
CPC ..... *C10M 159/12* (2013.01); *C10M 105/00* (2013.01); *C10M 127/00* (2013.01); *C10M 159/02* (2013.01); *C10M 159/04* (2013.01); *C10M 169/041* (2013.01); *C21D 1/58* (2013.01); *C10M 2203/003* (2013.01); *C10M 2203/10* (2013.01); *C10M 2205/026* (2013.01); *C10M 2205/18* (2013.01); *C10M 2205/20* (2013.01); *C10N 2220/021* (2013.01); *C10N 2220/022* (2013.01); *C10N 2230/00* (2013.01); *C10N 2230/02* (2013.01); *C10N 2230/08* (2013.01); *C10N 2240/404* (2013.01); *C10N 2260/02* (2013.01)

(58) Field of Classification Search
CPC ..... C21D 1/58
USPC ..... 148/29
See application file for complete search history.

(56) References Cited

U.S. PATENT DOCUMENTS

| | | | | |
|---|---|---|---|---|
| 2,327,977 | A | 8/1943 | Horst et al. | |
| 3,567,640 | A * | 3/1971 | Stroh | C10M 1/08 585/12 |
| 3,681,150 | A * | 8/1972 | Brewster | C10M 1/08 148/29 |
| 3,855,014 | A * | 12/1974 | De Vries | C10M 1/08 148/28 |
| 7,347,927 | B2 * | 3/2008 | Ichitani | C10M 171/02 148/29 |
| 7,851,422 | B2 * | 12/2010 | Ichitani | C10M 171/02 148/29 |
| 2003/0201205 | A1 * | 10/2003 | Ichitani | C10M 171/02 208/14 |
| 2007/0281873 | A1 * | 12/2007 | Okada | C10M 105/18 508/579 |
| 2009/0056834 | A1 * | 3/2009 | Kobessho | C10M 171/00 148/29 |
| 2009/0111723 | A1 * | 4/2009 | Shibata | B23H 1/08 508/463 |
| 2010/0093568 | A1 * | 4/2010 | Tagawa | C10M 101/02 508/133 |
| 2010/0186853 | A1 * | 7/2010 | Ichitani | C10M 129/28 148/29 |
| 2015/0013843 | A1 * | 1/2015 | Noguchi | C10M 107/04 148/29 |
| 2015/0361517 | A1 * | 12/2015 | Noguchi | C10M 145/22 148/29 |

FOREIGN PATENT DOCUMENTS

| | | | |
|---|---|---|---|
| CN | 1462314 | A | 12/2003 |
| CN | 1930309 | A | 3/2007 |
| CN | 101006164 | A | 7/2007 |
| CN | 101213313 | A | 7/2008 |

(Continued)

OTHER PUBLICATIONS

C9, Aromatic Resins, Eastman Tackifier Center. pp. 1-2.*

(Continued)

*Primary Examiner* — Ellen M McAvoy
(74) *Attorney, Agent, or Firm* — Oblon, McClelland, Maier & Neustadt, L.L.P.

(57) ABSTRACT

A heat treatment oil composition is provided that suppresses the decrease of luster in a heat treatment of a metal material, and is capable of suppressing the increase of the number of second (characteristic number of second) until reaching the temperature where the vapor blanket stage ends with the lapse of time and the decrease of the kinetic viscosity with the lapse of time. The heat treatment oil composition contains (A) a base oil and (B) a vapor blanket breaking agent selected from one or more of a petroleum resin, a terpene resin, rosin, and derivatives thereof.

10 Claims, No Drawings

(56) References Cited

FOREIGN PATENT DOCUMENTS

| | | | |
|---|---|---|---|
| CN | 101415807 | A | 4/2009 |
| CN | 101484560 | A | 7/2009 |
| CN | 101583726 | B | 8/2011 |
| CN | 102212662 | A | 10/2011 |
| CN | 101765640 | B | 6/2013 |
| CN | 104245968 | A | 12/2014 |
| CN | 105051219 | A | 11/2015 |
| JP | 49-15704 | A | 2/1974 |
| JP | 52-49204 | A | 4/1977 |
| JP | 2008-121094 | A | 5/2008 |
| JP | 2010-229479 | A | 10/2010 |
| JP | 2013-194262 | A | 9/2013 |
| WO | 2009/016942 | A1 | 2/2009 |

OTHER PUBLICATIONS

Hydrogenated C9 Aromatic Resins, Eastman Tackifier Center, pp. 1-2.*

C5/C9 Copolymerization Petroleum Resin, Puyang Tiancheng Chemical Co., LTD. 2 pages (2001).*

Puyang Tiancheng Chemical Co., LTD "Petroleum Resin", pp. 1-9 (Year: 2020).*

International Search Report dated Apr. 26, 2016 in PCT/JP2016/054454 filed Feb. 16, 2016.

Combined Chinese Office Action and Search Report dated Sep. 5, 2018 in Patent Application No. 201680010363.0 (with English translation of Categories of Cited Documents), 8 pages.

Xiaoping et al., "Production and Application Technologies of Additives for Petroleum Industry", China Petrochemical Press, Mar. 2014, 5 pages (with English Translation).

Office Action dated Jul. 12, 2019, in Chinese Patent Application No. 201680010363.0, filed Feb. 16, 2016 (with English Translation).

Office Action dated May 14, 2019, in Japanese Patent Application No. 2017-500692, filed Feb. 16, 2016 (with English Translation).

Office Action dated Feb. 14, 2019 in Taiwanese Patent Application No. 105104642.

Office Action dated Apr. 13, 2020, in Chinese Patent Application No. 201680010363.0 filed Feb. 16, 2016 (with English translation), citing documents AO-AT and AX.

Wang Duoren, " Green Degrading Chemicals", Scientific and Technical Documents Publish House, p. 391 (Jan. 2008).

* cited by examiner

HEAT TREATMENT OIL COMPOSITION

CROSS-REFERENCE TO RELATED APPLICATIONS

This application is a National Phase of PCT/JP2016/054454, which was filed on Feb. 16, 2016. This application is based upon and claims the benefit of priority to Japanese Application No. 2015-030024, which was filed on Feb. 18, 2015.

TECHNICAL FIELD

The present invention relates to heat treatment oil composition.

BACKGROUND ART

A metal material, such as a steel material, is subjected to heat treatments, such as quenching, tempering, annealing, and normalizing, for improving the property thereof. Among the heat treatments, quenching is a treatment for transforming a heated metal material to a prescribed quenched structure by immersing the metal material in a cooling medium, and the quenching makes the treated product very hard. For example, when a heated steel material in an austenite state is cooled at the upper critical cooling rate or higher by immersing in a cooling medium, the material can be transformed to a quenched structure, such as martensite.

As the cooling medium, an oily or aqueous heat treatment agent is generally used. The quenching of a metal material with an oily heat treatment agent (i.e., a heat treatment oil) will be described. In the case where a heated metal material is placed in a heat treatment oil as a cooling medium, the material is generally cooled through three stages. Specifically, the stages include (1) the first stage where the metal material is enclosed with a vapor blanket of the heat treatment oil (vapor blanket stage), (2) the second stage where the vapor blanket is ruptured, and boiling occurs (boiling stage), and (3) the third stage where the temperature of the metal material becomes the boiling point of the heat treatment oil or lower, and the heat is removed through convection (convection stage). The cooling rates in the stages are different from each other due to the difference of the atmosphere surrounding the metal material, and the cooling rate in the second stage (boiling stage) is the largest.

In a heat treatment oil, the cooling rate is generally increased quickly in the transition from the vapor blanket stage to the boiling stage. In the case where the metal material does not have a simple flat shape, the vapor blanket stage and the boiling stage tend to be mixedly present on the surface of the metal material. In the case where the stages are mixedly present, an extremely large temperature difference occurs on the surface of the metal material due to the difference in cooling rate between the vapor blanket stage and the boiling stage. The temperature difference forms temperature stress and transformation stress, which cause distortion of the metal material.

Therefore, in a heat treatment of a metal material, particularly quenching thereof, it is important to select a heat treatment oil that is proper for the heat treatment condition, and if the heat treatment oil is selected improperly, there may be a case where distortion occurs in the metal material, and sufficient quenching hardness cannot be obtained.

The heat treatment oil is classified into a cold oil used at a low oil temperature and a hot oil used at a high oil temperature.

The cold oil generally contains a low viscosity base oil to have a large cooling rate, and thus has high cooling property. However, the cold oil undergoes a long vapor blanket stage, which tends to make the vapor blanket stage and the boiling stage mixedly present on a surface of a metal material, and thus distortion tends to occur. Accordingly, in many case, a vapor blanket breaking agent is blended in the cold oil to shorten the vapor blanket stage.

The hot oil undergoes a short vapor blanket stage and hardly forms distortion, but in recent years, a vapor blanket breaking agent is blended in the hot oil in some cases for further decreasing distortion.

The vapor blanket breaking agent used above includes asphalt, and also includes an α-olefin copolymer (see PTL 1) and an imide compound (see PTL 2).

CITATION LIST

Patent Literatures

PTL 1: JP 2013-194262 A
PTL 2: JP 2010-229479 A

SUMMARY OF INVENTION

Technical Problem

The heat treatment oil using asphalt as a vapor blanket breaking agent is stable in the number of second (characteristic number of second) until reaching the temperature where the vapor blanket stage ends and in the kinetic viscosity, but has problems that the luster of the metal material subjected to the heat treatment may be lowered, and the surrounding of the oil tank may be contaminated to deteriorate the work environment.

The heat treatment oil using the α-olefin copolymer of PTL 1 or the imide compound of PTL 2 as a vapor blanket breaking agent does not cause the problems of the decrease of luster and the deterioration of the work environment, but may cause increase of the characteristic number of second and decrease of the kinetic viscosity with the lapse of time.

An object of the present invention is to provide a heat treatment oil composition that suppresses the decrease of luster in a heat treatment of a metal material, and is capable of suppressing the increase of the number of second (characteristic number of second) until reaching the temperature where the vapor blanket stage ends and the decrease of the kinetic viscosity with the lapse of time.

Solution to Problem

For solving the problem, one embodiment of the present invention provides a heat treatment oil composition containing (A) a base oil and (B) a vapor blanket breaking agent selected from one or more of a petroleum resin, a terpene resin, rosin, and derivatives thereof.

Advantageous Effects of Invention

The heat treatment oil composition of the present invention is capable of suppressing the decrease of luster of a metal material subjected to a heat treatment, such as quenching, and is capable of suppressing the increase of the number of second (characteristic number of second) until reaching the temperature where the vapor blanket stage ends with the lapse of time and the decrease of the kinetic viscosity with the lapse of time, under repetition of the heat treatment.

DESCRIPTION OF EMBODIMENTS

Embodiments of the present invention will be described below. The heat treatment oil composition of the embodiment contains (A) a base oil and (B) a vapor blanket breaking agent selected from one or more of a petroleum resin, a terpene resin, rosin, and derivatives thereof.

[(A) Base Oil]

Examples of the base oil as the component (A) include a mineral oil and/or a synthetic oil.

Examples of the mineral oil include a paraffin-based mineral oil, an intermediate-based mineral oil, a naphthene-based mineral oil, and the like, which are obtained by an ordinary refining method, such as solvent refining and hydrogenation refining; and a wax isomerized oil, which is produced through isomerization of wax, such as was produced by the Fischer-Tropsch process or the like (gas-to-liquid wax), and mineral oil wax.

Examples of the synthetic oil include a hydrocarbon synthetic oil and an ether synthetic oil. Examples of the hydrocarbon synthetic oil include an alkylbenzene and an alkylnaphthalene. Examples of the ether synthetic oil include a polyoxyalkylene glycol and a polyphenyl ether.

The base oil as the component (A) may be a single component system using one of the mineral oils and the synthetic oils described above, or may be a mixed system obtained by mixing two or more of the mineral oils, mixing two or more of the synthetic oils, or mixing one or two or more each of the mineral oils and the synthetic oils.

The preferred range of the 40° C. kinetic viscosity of the base oil as the component (A) may not be determined unconditionally since it may vary between a cold oil and a hot oil, and is generally preferably in a range of from 5 to 500 $mm^2/s$.

In the case where the heat treatment oil composition is used as a cold oil, the 40° C. kinetic viscosity of the base oil as the component (A) is more preferably 5 $mm^2/s$ or more and less than 40 $mm^2/s$. In the case where the heat treatment oil composition is used as a hot oil, the 40° C. kinetic viscosity of the base oil as the component (A) is more preferably 40 $mm^2/s$ or more and 500 $mm^2/s$ or less.

In the case where the base oil as the component (A) is a base oil containing two or more base oils mixed, the mixed base oil preferably has a kinetic viscosity that satisfies the aforementioned range.

In the embodiment, the kinetic viscosity of the base oil and the heat treatment oil composition can be measured according to JIS K2283:2000.

The content ratio of the base oil as the component (A) based on the total amount of the heat treatment oil composition is preferably 80% by mass or more and less than 100% by mass, and more preferably 85% by mass or more and 98% by mass or less.

When the content ratio of the component (A) is 80% by mass or more, the essential cooling capability based on the component (A) can be ensured, and when the content ratio of the component (A) is less than 100% by mass, the amount of the vapor blanket breaking agent used can be ensured to decrease the characteristic number of second, and thereby the fluctuation in distortion and hardness of the metal material can be suppressed.

[(B) Vapor blanket breaking Agent]

The vapor blanket breaking agent as the component (B) used is one or more selected from a petroleum resin, a terpene resin, rosin, and derivatives thereof.

The use of the vapor blanket breaking agent can suppress the decrease of luster of a metal material subjected to a heat treatment, such as quenching. Furthermore, the use of the vapor blanket breaking agent can suppress the increase of the number of second (characteristic number of second) until reaching the temperature where the vapor blanket stage ends with the lapse of time and the decrease of the kinetic viscosity with the lapse of time, under repetition of the heat treatment. Accordingly, the use of the vapor blanket breaking agent can prolong the lifetime of the heat treatment oil composition.

It is considered that the vapor blanket breaking agent can exhibit the aforementioned effects due to the thermoplastic characteristics of the petroleum resin, the terpene resin, the rosin, and the derivatives thereof and the excellent solubility thereof in the base oil.

The vapor blanket breaking agent can decrease the characteristic number of second in the initial stage of the heat treatment. Therefore, the vapor blanket breaking agent can decrease the characteristic number of second over a prolonged period of time, and the fluctuation in distortion and hardness of the metal material due to the prolongation of the vapor blanket stage can be suppressed.

The petroleum resin is a resin that is obtained through polymerization or copolymerization of one kind or two or more kinds of an unsaturated compound selected from an aliphatic olefin compound and an aliphatic diolefin compound having a number of carbon atoms of from 4 to 10 obtained as a by-product in the production of an olefin, such as ethylene, through thermal cracking of a petroleum product, such as naphtha, and an aromatic compound having a number of carbon atoms of 8 or more and having an olefinic unsaturated bond. The petroleum resin can be roughly classified, for example, into an "aliphatic petroleum resin" obtained through polymerization of an aliphatic olefin compound or an aliphatic diolefin compound, an "aromatic petroleum resin" obtained through polymerization of an aromatic compound having an olefinic unsaturated bond, and an "aliphatic-aromatic copolymerized petroleum resin" obtained through copolymerization of an aliphatic olefin compound or an aliphatic diolefin compound and an aromatic compound having an olefinic unsaturated bond.

Examples of the aliphatic olefin compound having a number of carbon atoms of from 4 to 10 include butene, pentene, hexene, and heptene. Examples of the aliphatic diolefin compound having a number of carbon atoms of from 4 to 10 include butadiene, pentadiene, isoprene, cyclopentadiene, dicyclopentadiene, and methylpentadiene. Examples of the aromatic compound having a number of carbon atoms of 8 or more and having an olefinic unsaturated bond include styrene, α-methylstyrene, β-methylstyrene, vinyltoluene, vinylxylene, indene, methylindene, and ethylindene.

The raw material compound of the petroleum resin may not be entirely a by-product in the production of an olefin through thermal cracking of a petroleum product, such as naphtha, and a chemically synthesized unsaturated compound may also be used. Examples thereof include a dicyclopentadiene petroleum resin obtained through polymerization of cyclopentadiene or dicyclopentadiene, and a dicyclopentadiene-styrene petroleum resin obtained through copolymerization of cyclopentadiene or dicyclopentadiene and styrene.

Examples of the derivative of a petroleum resin include a hydrogenated petroleum resin obtained by adding hydrogen atoms to the aforementioned petroleum resin. Examples of the derivative of a petroleum resin also include an acid-modified petroleum resin obtained through modification of the petroleum resin with an acidic functional group represented by a carboxylic acid, and a compound obtained through reaction modification of the acid-modified petroleum resin with a compound, such as an alcohol, an amine, an alkali metal, and an alkaline earth metal.

The acid-modified petroleum resin can be roughly classified into a carboxylic acid-modified petroleum resin and an acid anhydride-modified petroleum resin obtained through modification of the petroleum resin with an unsaturated carboxylic acid and an unsaturated carboxylic acid anhydride. Examples of the unsaturated carboxylic acid include an unsaturated monocarboxylic acid, such as acrylic acid and methacrylic acid; an unsaturated polybasic carboxylic acid, such as maleic acid, fumaric acid, itaconic acid, and citraconic acid; and a partial ester compound of an unsaturated polybasic carboxylic acid, such as monomethyl maleate and monoethyl fumarate, and examples of the unsaturated carboxylic acid anhydride include an unsaturated polybasic carboxylic acid anhydride, such as maleic anhydride and itaconic anhydride.

The petroleum resin or the derivative of a petroleum resin is preferably an aliphatic-aromatic copolymerized petroleum resin or a hydrogenated aliphatic-aromatic copolymerized petroleum resin since the characteristic number of second tends to be decreased.

The number average molecular weight of the petroleum resin or the derivative of a petroleum resin is preferably from 200 to 5,000, more preferably from 250 to 2,500, and further preferably from 300 to 1,500, from the standpoint of easily exhibiting the effect of the embodiment.

The terpene resin is obtained through polymerization of a terpene monomer containing isoprene as a constitutional unit.

Examples of the derivative of a terpene resin include a copolymerized resin of a terpene monomer and another monomer, an aromatic-modified terpene resin obtained through modification of a terpene resin with an aromatic monomer, and a hydrogenated terpene resin obtained by adding hydrogen atoms to the terpene resin, the copolymerized resin, or the modified terpene resin. Example of the copolymerized resin include a terpen phenol resin.

The rosin is a nonvolatile component of a pine resin contained in a large amount in pinaceae plants, and contains abietic acid, neoabietic acid, palustric acid, pimaric acid, isopimaric acid, and dehydroabietic acid, as major components.

Examples of the derivative of rosin include a rosin ester obtained through esterification of rosin, a maleic acid-modified rosin resin obtained through modification of rosin with maleic acid, a fumaric acid-modified rosin resin obtained through modification of rosin with fumaric acid, polymerized rosin, a polymerized rosin ester, a rosin-modified phenol resin, hardened rosin, and disproportionated rosin, and also include hydrogenated rosin and a hydrogenated rosin derivative obtained by adding hydrogen atoms to the rosin, the rosin ester, the maleic acid-modified rosin resin, the fumaric acid-modified rosin resin, the polymerized rosin, the polymerized rosin ester, the rosin-modified phenol resin, the hardened rosin, or the disproportionated rosin.

The vapor blanket breaking agent preferably has a softening point measured by the ring and ball method of JIS K2207:2006 of 40° C. or more, more preferably 60° C. or more and 150° C. or less, further preferably 80° C. or more and 140° C. or less, and still further preferably 85° C. or more and 130° C. or less.

When the softening point of the vapor blanket breaking agent is 40° C. or less, the increase of the characteristic number of second with the lapse of time and the decrease of the kinetic viscosity with the lapse of time can be further suppressed, and the characteristic number of second in the initial stage of the heat treatment can be decreased. Accordingly, when the softening point of the vapor blanket breaking agent is 40° C. or more, the characteristic number of second can be decreased not only in the initial stage but also after the repeated use, and the fluctuation in distortion and hardness of the metal material due to the prolongation of the vapor blanket stage can be suppressed over a prolonged period of time. Furthermore, the decrease of the kinetic viscosity with the lapse of time can be suppressed, and thus the properties of the heat treatment oil composition can be stabilized for a prolonged period of time, so as to prolong the lifetime of the heat treatment oil composition.

When the softening point of the vapor blanket breaking agent is 150° C. or less, stickiness on the surface of the processed material, such as the metal material, having been cooled with the heat treatment oil composition can be suppressed.

The softening point of the vapor blanket breaking agent can be controlled by the polymerization degree of the petroleum resin and the terpene resin, the modification component therefor, and the modification degree thereof.

In the case where two or more kinds of materials are used as the vapor blanket breaking agent, all the materials preferably have a softening point within the aforementioned range. A vapor blanket breaking agent outside the aforementioned scope may also be combined in such a range that does not impair the characteristic number of second, the kinetic viscosity, and the luster.

The content ratio of the vapor blanket breaking agent as the component (B) based on the total amount of the heat treatment oil composition is preferably more than 0% by mass and 20% by mass or less, and more preferably 2% by mass or more and 15% by mass or less.

When the content ratio of the component (B) is more than 0% by mass, the characteristic number of second can be decreased, and the fluctuation in distortion and hardness of the metal material can be suppressed, and when the content ratio of the component (A) is 20% by mass or less, the amount of the component (A) used, which secures the essential cooling capability, can be ensured to impart the cooling capability to the heat treatment oil composition.

The total content of the component (A) and the component (B) is preferably 80% by mass or more, more preferably 90% by mass or more, and further preferably 100% by mass, based on the total amount of the heat treatment oil composition.

[(C) Additives]

The heat treatment oil composition of the embodiment may contain an additive, such as an antioxidant and a cooling capability improver.

The content ratios of the antioxidant, the cooling capability improver, and the like each are preferably 10% by mass or less, and more preferably from 0.01 to 5% by mass based on the total amount of the heat treatment oil composition.

[Properties of Heat Treatment Oil Composition]

The heat treatment oil composition of the embodiment preferably has a characteristic number of second obtained from a cooling curve obtained according to the cooling capability test method of JIS K2242:2012 of 3.00 seconds or less, more preferably 2.75 seconds or less, and further preferably 2.50 seconds or less.

The characteristic number of second can be more specifically calculated by the following procedures (1) and (2).

(1) According to the cooling capability test method of JIS K2242:2012, a silver specimen heated to 810° C. is placed in the heat treatment oil composition, and a cooling curve is obtained with the x-axis for the time and the y-axis for the temperature on the surface of the silver specimen.

(2) In the cooling curve, the number of second until reaching the temperature (characteristic temperature) where the vapor blanket stage of the heat treatment oil composition ends is calculated by the tangent crossover method, and the number of second is designated as the characteristic number of second.

In the procedure (1), the time interval of measurement is preferably 1/100 second.

When the characteristic number of second of the heat treatment oil composition is 3.00 seconds or less, the fluctuation in distortion and hardness of the metal material due to the prolongation of the vapor blanket stage can be suppressed.

In the case where the heat treatment oil composition of the embodiment is used as a cold oil, the 40° C. kinetic viscosity thereof is preferably from 10 to 30 $mm^2/s$, and more preferably from 15 to 25 $mm^2/s$.

In the case where the heat treatment oil composition of the embodiment is used as a hot oil, the 100° C. kinetic viscosity thereof is preferably from 10 to 30 $mm^2/s$, and more preferably from 15 to 20 $mm^2/s$.

EXAMPLES

The present invention will be described more specifically with reference to examples below, but the present invention is not limited to the examples.

A. Evaluations and Measurements

A-1. Luster

The luster was evaluated in the following manner with reference to "Influence on luster by oxygen in heat treatment oil bath" (Idemitsu Tribo Review, No. 31, pp. 1963-1966, issued on September 30, Heisei 20 (2008)).

A dumbbell shaped metal material (diameter: 16 mm, steel species: S45C) and a cylindrical metal material (diameter: 10 mm, steel species: SUJ2) were combined to prepare a test specimen. The test specimen was heated to 850° C. in an atmosphere of a mixed gas of nitrogen and hydrogen. The test specimen was quenched by placing in a heat treatment oil composition at 80° C. The "luminosity" of the test specimen after quenching was evaluated by the following standard.

<Evaluation of Luminosity>

The luminosity of the S45C portion of the test specimen after quenching and the luminosity of the S45C portion of the test specimen before quenching were compared, and the luminosity of the S45C portion after quenching was evaluated by the following standard. The similar evaluation was also performed for the SUJ2 portion of the test specimen after quenching.

0: The value of the following expression (1) was 85% or more.

1: The value of the following expression (1) was 60% or more and less than 85%.

2: The value of the following expression (1) was less than 60%.

$$(\text{luminosity of test specimen after quenching}/\text{luminosity of test specimen before quenching})\times 100 \quad (1)$$

A-2. Initial Cooling Capability

According to the cooling capability test method defined in JIS K2242:2012, a silver specimen heated to 810° C. was placed in the heat treatment oil composition, a cooling curve of the silver specimen was obtained, and the "characteristic number of second" below was calculated. The temperature of the heat treatment oil composition before placing the silver specimen therein was 80° C. for a cold oil (Examples 1-1 to 1-6, Comparative Examples 1-1 to 1-3, Examples 3-1 to 3-30, and Comparative Example 3) or 120° C. for a hot oil (Examples 2-1 to 2-3 and Comparative Examples 2-1 and 2-2).

<Characteristic Number of Second>

In the cooling curve, according to JIS K2242:2012, the temperature (characteristic temperature) where the vapor blanket stage of the heat treatment oil composition ended was calculated, and the number of second until reaching the temperature was designated as the characteristic number of second.

A-3. Temporal Stability of Cooling Capability

The result in the item A-2 above was designated as the result before the repeated quenching deterioration test. The repeated quenching deterioration test was then performed under the following condition. After performing the repeated quenching deterioration test, the same test and evaluation as in the item A-2 were performed to obtain a result, which was designated as the result after the repeated quenching deterioration test. The change rate before and after the test was calculated by the following expression (2).

$$[(\text{value after test}-\text{value before test})/\text{value before test}]\times 100 \quad (2)$$

<Test Condition>

Test piece: SUS316

Quenching temperature: 850° C.

Oil amount: 400 mL

Oil temperature: 130° C. (cold oil, Examples 1-1 to 1-6 and Comparative Examples 1-1 to 1-3) or 170° C. (hot oil, Examples 2-1 to 2-3 and Comparative Examples 2-1 and 2-2)

Number of times of quenching: 200

A-4. Kinetic Viscosity

According to JIS K2283:2000, the heat treatment oil composition was measured for the 40° C. kinetic viscosity for cold oils (Examples 1-1 to 1-6 and Comparative Examples 1-1 to 1-3) or the 100° C. kinetic viscosity for hot oils (Examples 2-1 to 2-3 and Comparative Examples 2-1 and 2-2) before and after the repeated quenching deterioration test of the item A-3.

2. Preparation and Evaluation of Cold Oils (Examples 1-1 to 1-6 and Comparative Examples 1-1 to 1-3)

Heat treatment oil compositions having the compositions shown in Table 1 were prepared and subjected to the evaluations of the items A-1 to A-4. The results are shown in Table 1.

TABLE 1

| | | | Example 1-1 | Example 1-2 | Example 1-3 | Example 1-4 | Example 1-5 | Example 1-6 | Comparative Example 1-1 | Comparative Example 1-2 | Comparative Example 1-3 |
|---|---|---|---|---|---|---|---|---|---|---|---|
| Base oil (% by mass) | | Base oil 1 | 94 | 94 | 94 | 94 | 94 | 97 | 94 | 94 | 97 |
| Vapor blanket breaking agent (% by mass) | | Petroleum resin 1 | 6 | — | — | — | — | — | — | — | — |
| | | Terpene resin 1-1 | — | 6 | — | — | — | — | — | — | — |
| | | Terpene resin 1-2 | — | — | 6 | — | — | — | — | — | — |
| | | Rosin 1-1 | — | — | — | 6 | — | — | — | — | — |
| | | Rosin 1-2 | — | — | — | — | 6 | 3 | — | — | — |
| | | Asphaltene | — | — | — | — | — | — | 6 | — | — |
| | | Polybutene | — | — | — | — | — | — | — | 6 | 3 |
| Total | | | 100 | 100 | 100 | 100 | 100 | 100 | 100 | 100 | 100 |
| Luster | | S45C luminosity | 0 | 0 | 0 | 0 | 0 | 0 | 2 | 2 | 0 |
| | | SUJ2 luminosity | 0 | 0 | 0 | 0 | 0 | 0 | 2 | 1 | 0 |
| Cooling capability | Before test | 40° C. kinetic viscosity ($mm^2/s$) | 19.08 | 19.06 | 19.06 | 18.49 | 18.94 | 16.50 | 19.02 | 24.57 | 18.88 |
| | | Characteristic number of second (sec) | 1.68 | 1.81 | 1.76 | 1.91 | 1.54 | 2.09 | 1.86 | 1.52 | 1.78 |
| | After test | 40° C. kinetic viscosity ($mm^2/s$) | 19.69 | 19.71 | 19.77 | 18.21 | 19.27 | 16.77 | 18.68 | 18.59 | 15.84 |
| | | Characteristic number of second (sec) | 1.52 | 1.85 | 1.82 | 2.11 | 1.61 | 2.35 | 1.96 | 1.77 | 3.20 |
| | Change rate before and after test (%) | 40° C. kinetic viscosity | 3.2 | 3.4 | 3.7 | −1.5 | 1.7 | 1.6 | −1.8 | −24.3 | −16.1 |
| | | Characteristic number of second | −9.5 | 2.2 | 3.4 | 10.5 | 4.5 | 12.4 | 5.4 | 16.4 | 79.8 |

The materials shown in Table 1 are as follows.

Base oil 1: mineral oil, 40° C. kinetic viscosity: 15 $mm^2/s$

Petroleum resin 1: partially hydrogenated aliphatic-aromatic copolymerized petroleum resin, softening point: 110° C., number average molecular weight: 760

Terpene resin 1-1: hydrogenated terpene resin, softening point: 115C

Terpene resin 1-2: aromatic-modified terpene resin, softening point: 115C

Rosin 1-1: rosin-modified maleic acid resin, softening point: 100° C.

Rosin 1-2: polymerized rosin ester, softening point: 120° C.

Asphaltene: asphalt, 100° C. kinetic viscosity: 490 $mm^2/s$

Polybutene: polybutene, 100° C. kinetic viscosity: 4,550 $mm^2/s$

As is clear from the results in Table 1, it is confirmed that the heat treatment oil compositions of Examples 1-1 to 1-6 each can suppress the deterioration in capability of the heat treatment oil composition with the lapse of time (i.e., the increase of the characteristic number of second and the decrease of the kinetic viscosity) while suppressing the decrease of the luster of the metal material in the heat treatment.

It is also confirmed that the heat treatment oil compositions of Examples 1-1 to 1-6 each have a small characteristic number of second in the initial stage, and thus can have a small characteristic number of second over a prolonged period of time, i.e., in the initial stage and after the repeated use.

3. Preparation and Evaluation of Hot Oils

Examples 2-1 to 2-3 and Comparative Examples 2-1 and 2-2

Heat treatment oil compositions having the compositions shown in Table 2 were prepared and subjected to the evaluations of the items A-1 to A-4. The results are shown in Table 2.

TABLE 2

| | | Example 2-1 | Example 2-2 | Example 2-3 | Comparative Example 2-1 | Comparative Example 2-2 |
|---|---|---|---|---|---|---|
| Base oil (% by mass) | Base oil 2-1 | 90 | 90 | 90 | — | — |
| | Base oil 2-2 | — | — | — | 91 | — |
| | Base oil 2-3 | — | — | — | — | 88 |
| Vapor blanket breaking agent (% by mass) | Petroleum resin 2-1 | 10 | — | — | — | — |
| | Petroleum resin 2-2 | — | 10 | — | — | — |
| | Terpene resin 2-1 | — | — | 10 | — | — |
| | Asphaltene | — | — | — | — | 12 |
| | α-Olefin copolymer | — | — | — | 8 | — |
| Antioxidant | | — | — | — | 1 | — |
| Total | | 100 | 100 | 100 | 100 | 100 |
| Luster | S45C luminosity | 0 | 0 | 0 | 0 | 2 |
| | SUJ2 luminosity | 0 | 0 | 0 | 0 | 2 |

TABLE 2-continued

| | | | Example 2-1 | Example 2-2 | Example 2-3 | Comparative Example 2-1 | Comparative Example 2-2 |
|---|---|---|---|---|---|---|---|
| Cooling capability | Before test | 100° C. kinetic viscosity ($mm^2/s$) | 18.00 | 19.25 | 18.16 | 17.41 | 19.01 |
| | | Characteristic number of second (sec) | 0.86 | 0.65 | 1.07 | 0.53 | 1.09 |
| | After test | 100° C. kinetic viscosity ($mm^2/s$) | 17.77 | 18.51 | 18.21 | 13.60 | 18.56 |
| | | Characteristic number of second (sec) | 0.85 | 0.72 | 1.06 | 0.77 | 1.10 |
| | Change rate before and after test (%) | 100° C. kinetic viscosity | −1.3 | −3.8 | 0.3 | −21.9 | −2.4 |
| | | Characteristic number of second | −1.2 | 10.8 | −0.9 | 45.3 | 0.9 |

The materials shown in Table 2 are as follows.

Base oil 2-1: mineral oil, 40° C. kinetic viscosity: 120 $mm^2/s$

Base oil 2-2: mineral oil, 40° C. kinetic viscosity: 60 $mm^2/s$

Base oil 2-3: mineral oil, 40° C. kinetic viscosity: 125 $mm^2/s$

Petroleum resin 2-1: partially hydrogenated aliphatic-aromatic copolymerized petroleum resin, softening point: 110° C., number average molecular weight: 760

Petroleum resin 2-2: completely hydrogenated aliphatic-aromatic copolymerized petroleum resin, softening point: 140° C., number average molecular weight: 900

Terpene resin 2-1: hydrogenated terpene resin, softening point: 115° C.

Asphaltene: asphalt, 100° C. kinetic viscosity: 490 $mm^2/s$

α-Olefin copolymer: α-olefin copolymer, 100° C. kinetic viscosity: 2,000 $mm^2/s$ As is clear from the results in Table 2, it is confirmed that the heat treatment oil compositions of Examples 2-1 to 2-3 each can suppress the deterioration in capability of the heat treatment oil composition with the lapse of time (i.e., the increase of the characteristic number of second and the decrease of the kinetic viscosity) while suppressing the decrease of the luster of the metal material in the heat treatment.

It is also confirmed that the heat treatment oil compositions of Examples 2-1 to 2-3 each have a small characteristic number of second in the initial stage, and thus can have a small characteristic number of second over a prolonged period of time, i.e., in the initial stage and after the repeated use.

4. Confirmation of Effect of Vapor Blanket Breaking Agent

Examples 3-1 to 3-30 and Comparative Example 3

Heat treatment oil (cold oils) compositions having the compositions shown in Tables 3 to 5 were prepared and subjected to the evaluation of the item A-2. The results are shown in Tables 3 to 5.

TABLE 3

| | | Example 3-1 | Example 3-2 | Example 3-3 | Example 3-4 | Example 3-5 | Example 3-6 | Example 3-7 | Example 3-8 | Example 3-9 | Example 3-10 |
|---|---|---|---|---|---|---|---|---|---|---|---|
| Base oil 3-1 (% by mass) | | 94 | 94 | 94 | 94 | 94 | 94 | 94 | 94 | 94 | 94 |
| Vapor blanket breaking agent | Kind of material | Petroleum 3-1 | Petroleum 3-2 | Petroleum 3-3 | Petroleum 3-4 | Petroleum 3-5 | Petroleum 3-6 | Petroleum 3-7 | Petroleum 3-8 | Petroleum 3-9 | Petroleum 3-10 |
| | Content ratio (% by mass) | 6 | 6 | 6 | 6 | 6 | 6 | 6 | 6 | 6 | 6 |
| Total | | 100 | 100 | 100 | 100 | 100 | 100 | 100 | 100 | 100 | 100 |
| 40° C. kinetic viscosity ($mm^2/s$) | | 17.96 | 19.08 | 18.85 | 18.52 | 18.90 | 18.83 | 18.03 | 18.53 | 17.98 | 18.35 |
| Cooling capability | Characteristic number of second (sec) | 1.63 | 1.68 | 2.12 | 1.70 | 1.56 | 2.38 | 2.91 | 2.27 | 2.40 | 2.17 |

TABLE 4

| | | Example 3-11 | Example 3-12 | Example 3-13 | Example 3-14 | Example 3-15 | Example 3-16 | Example 3-17 | Example 3-18 | Example 3-19 |
|---|---|---|---|---|---|---|---|---|---|---|
| Base oil 3-1 (% by mass) | | 94 | 94 | 94 | 94 | 94 | 94 | 94 | 94 | 94 |
| Vapor blanket breaking agent | Kind of material | Petroleum 3-11 | Petroleum 3-12 | Petroleum 3-13 | Petroleum 3-14 | Petroleum 3-15 | Petroleum 3-16 | Petroleum 3-17 | Petroleum 3-18 | Petroleum 3-19 |
| | Content ratio (% by mass) | 6 | 6 | 6 | 6 | 6 | 6 | 6 | 6 | 6 |
| Total | | 100 | 100 | 100 | 100 | 100 | 100 | 100 | 100 | 100 |
| 40° C. kinetic viscosity ($mm^2/s$) | | 17.54 | 17.97 | 18.04 | 18.38 | 18.40 | 18.25 | 17.84 | 18.27 | 18.19 |
| Cooling capability | Characteristic number of second (sec) | 2.62 | 2.38 | 2.27 | 2.00 | 2.08 | 1.92 | 2.10 | 2.32 | 2.06 |

TABLE 5

| | | Example 3-20 | Example 3-21 | Example 3-22 | Example 3-23 | Example 3-24 | Example 3-25 | Example 3-26 |
|---|---|---|---|---|---|---|---|---|
| Base oil 3-1 (% by mass) | | 94 | 94 | 94 | 94 | 94 | 94 | 94 |
| Vapor blanket breaking agent | Kind of material | Terpene 3-1 | Terpene 3-2 | Terpene 3-3 | Terpene 3-4 | Terpene 3-5 | Terpene 3-6 | Terpene 3-7 |
| | Content ratio (% by mass) | 6 | 6 | 6 | 6 | 6 | 6 | 6 |
| Total | | 100 | 100 | 100 | 100 | 100 | 100 | 100 |
| 40° C. kinetic viscosity ($mm^2/s$) | | 19.20 | 19.98 | 19.06 | 19.10 | 18.96 | 19.06 | 19.06 |
| Cooling capability | Characteristic number of second (sec) | 2.27 | 2.06 | 1.81 | 2.62 | 2.97 | 1.76 | 1.93 |

| | | Example 3-27 | Example 3-28 | Example 3-29 | Example 3-30 | Comparative Example 3 |
|---|---|---|---|---|---|---|
| Base oil 3-1 (% by mass) | | 94 | 94 | 94 | 94 | 100 |
| Vapor blanket breaking agent | Kind of material | Rosin 3-1 | Rosin 3-2 | Rosin 3-3 | Rosin 3-4 | — |
| | Content ratio (% by mass) | 6 | 6 | 6 | 6 | — |
| Total | | 100 | 100 | 100 | 100 | 100 |
| 40° C. kinetic viscosity ($mm^2/s$) | | 18.11 | 18.49 | 18.36 | 18.94 | 14.51 |
| Cooling capability | Characteristic number of second (sec) | 2.71 | 1.91 | 2.48 | 1.54 | 5.12 |

The materials shown in Tables 3 to 5 are as follows.

Base oil 3-1: mineral oil, 40° C. kinetic viscosity: 15 $mm^2/s$

Petroleum 3-1: partially hydrogenated aliphatic-aromatic copolymerized petroleum resin, softening point: 100° C., number average molecular weight: 700

Petroleum 3-2: partially hydrogenated aliphatic-aromatic copolymerized petroleum resin, softening point: 110° C., number average molecular weight: 760

Petroleum 3-3: completely hydrogenated aliphatic-aromatic copolymerized petroleum resin, softening point: 100° C., number average molecular weight: 660

Petroleum 3-4: completely hydrogenated aliphatic-aromatic copolymerized petroleum resin, softening point: 125° C., number average molecular weight: 820

Petroleum 3-5: completely hydrogenated aliphatic-aromatic copolymerized petroleum resin, softening point: 140° C., number average molecular weight: 900

Petroleum 3-6: aliphatic petroleum resin, softening point: 99° C., number average molecular weight: 1,300

Petroleum 3-7: aliphatic petroleum resin, softening point: 94° C., number average molecular weight: 1,000

Petroleum 3-8: aliphatic-aromatic copolymerized petroleum resin, softening point: 103° C., number average molecular weight: 900

Petroleum 3-9: hydrogenated aliphatic petroleum resin, softening point: 105° C., number average molecular weight: 400

Petroleum 3-10: hydrogenated aliphatic petroleum resin, softening point: 125° C., number average molecular weight: 430

Petroleum 3-11: hydrogenated aliphatic petroleum resin, softening point: 87° C., number average molecular weight: 370

Petroleum 3-12: hydrogenated aliphatic petroleum resin, softening point: 103° C., number average molecular weight: 410

Petroleum 3-13: partially hydrogenated aliphatic petroleum resin, softening point: 102° C., number average molecular weight: 500

Petroleum 3-14: hydrogenated aliphatic petroleum resin, softening point: 124° C., number average molecular weight: 430

Petroleum 3-15: partially hydrogenated petroleum resin, softening point: 130° C., number average molecular weight: 500

Petroleum 3-16: completely hydrogenated petroleum resin, softening point: 130° C., number average molecular weight: 500

Petroleum 3-17: aliphatic petroleum resin, softening point: 120° C.

Petroleum 3-18: aliphatic petroleum resin, softening point: 115° C.

Petroleum 3-19: aliphatic petroleum resin, softening point: 125° C.

Terpene 3-1: terpene resin, softening point: 115° C.

Terpene 3-2: terpene resin (pinene polymer), softening point: 115° C.

Terpene 3-3: hydrogenated terpene resin, softening point: 115° C.

Terpene 3-4: terpene-phenol resin, softening point: 115° C.

Terpene 3-5: hydrogenated terpene-phenol resin, softening point: 115° C.

Terpene 3-6: aromatic-modified terpene resin, softening point: 115° C.

Terpene 3-7: aromatic-modified hydrogenated terpene resin, softening point: 115° C.

Rosin 3-1: modified rosin ester, softening point: 104° C.

Rosin 3-2: rosin-modified maleic acid resin, softening point: 100° C.

Rosin 3-3: rosin ester, softening point: 80° C.

Rosin 3-4: polymerized rosin ester, softening point: 120° C.

It is confirmed from the results in Tables 3 to 5 that the vapor blanket breaking agent selected from one or more of a petroleum resin, a terpene resin, rosin, and derivatives thereof has a small characteristic number of second and is excellent in vapor blanket breaking effect.

INDUSTRIAL APPLICABILITY

The heat treatment oil composition of the embodiment is capable of suppressing the decrease of luster of a metal material subjected to a heat treatment, and is capable of suppressing the increase of the number of second (characteristic number of second) until reaching the temperature where the vapor blanket stage ends with the lapse of time and the decrease of the kinetic viscosity with the lapse of time, under repetition of the heat treatment of the metal material. Therefore, the heat treatment oil composition of the embodiment is favorably used as a heat treatment oil for heat treatments, such as quenching, annealing, and tempering, of an alloy steel, such as a carbon steel, a nickel-manganese steel, a chromium-molybdenum steel, and a manganese steel, and particularly favorably used as a heat treatment oil for quenching.

The invention claimed is:

1. A heat treatment oil composition, comprising:

(A) a base oil; and (B) at least one vapor blanket breaking agent selected from the group consisting of:

a derivative of a terpene resin selected from the group consisting of a hydrogenated terpene resin, an aromatic-modified terpene resin and an aromatic-modified hydrogenated terpene resin, a rosin, and a derivative of a rosin selected from the group consisting of a rosin ester, a maleic acid-modified rosin resin, a fumaric acid-modified rosin resin, a polymerized rosin, a polymerized rosin ester, a rosin-modified phenol resin, a hardened rosin, a disproportionated rosin, and hydrogenated compounds thereof.

2. The heat treatment oil composition according to claim 1, wherein the vapor blanket breaking agent is selected from the group consisting of the derivative of the terpene resin, the rosin, and the derivative of the rosin, each have a softening point measured by the ring and ball method of JIS K2207:2006 of 40° C. or more.

3. The heat treatment oil composition according to claim 2, wherein the vapor blanket breaking agent is selected from the group consisting of the derivative of the terpene resin, the rosin, and the derivative of the rosin, each have a softening point measured by the ring and ball method of JIS K2207:2006 of 60° C. or more and 150° C. or less.

4. The heat treatment oil composition according to claim 1, wherein the base oil as the component (A) has a 40° C. kinetic viscosity of from 5 to 500 $mm^2/s$.

5. The heat treatment oil composition according to claim 1, comprising:

80% by mass or more and less than 100% by mass of the base oil; and more than 0% by mass and 20% by mass or less of the vapor blanket breaking agent, based on a total mass of the heat treatment oil composition.

6. The heat treatment oil composition according to claim 1, wherein the heat treatment oil composition has a characteristic number of second obtained from a cooling curve obtained according to the cooling capability test method of JIS K2242:2012 of 2.50 seconds or less.

7. The heat treatment oil composition according to claim 1, wherein the at least one vapor blanket breaking agent is the derivative of a terpene resin.

8. The heat treatment oil composition according to claim 1, wherein the at least one vapor blanket breaking agent is selected from the group consisting of:

the rosin, and the derivative of a rosin.

9. The heat treatment oil composition according to claim 1, wherein the heat treatment oil composition has a characteristic number of second obtained from a cooling curve obtained according to the cooling capability test method of JIS K2242:2012 of 2.09 seconds or less.

10. The heat treatment oil composition according to claim 1, wherein the heat treatment oil composition has a characteristic number of second obtained from a cooling curve obtained according to the cooling capability test method of JTS K2242:2012 of 1.70 seconds or less.

* * * * *